US007570136B2

(12) United States Patent
Hesselbarth

(10) Patent No.: US 7,570,136 B2
(45) Date of Patent: Aug. 4, 2009

(54) RE-ENTRANT RESONANT CAVITIES, FILTERS INCLUDING SUCH CAVITIES AND METHOD OF MANUFACTURE

(75) Inventor: Jan Hesselbarth, Dublin (IE)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 45 days.

(21) Appl. No.: 11/524,136

(22) Filed: Sep. 20, 2006

(65) Prior Publication Data

US 2008/0068111 A1 Mar. 20, 2008

(51) Int. Cl.
*H01P 1/205* (2006.01)
*H01P 7/04* (2006.01)

(52) U.S. Cl. ..... 333/206; 333/222

(58) Field of Classification Search ..... 333/206–208, 333/222–226, 231–234
See application file for complete search history.

(56) References Cited

U.S. PATENT DOCUMENTS 2,504,109 A * 4/1950 Dakin et al. ..... 219/756
4,477,786 A 10/1984 Tamura et al. ..... 333/202 X
4,679,011 A * 7/1987 Praba et al. ..... 333/111
4,890,054 A * 12/1989 Maeno et al. ..... 324/640
5,329,687 A 7/1994 Scott et al. ..... 29/527.2
2007/0194865 A1 * 8/2007 Weitzenberger et al. ..... 333/206

FOREIGN PATENT DOCUMENTS

GB 630355 10/1949
WO WO 2005086275 A1 * 9/2005
WO WO2006/029868 3/2006

OTHER PUBLICATIONS

Krupta et al., "Measurements of the complex premittivity of microwave circuit board substrates using split dielectric resonator and reentrant cavity techniques," Dielectric Materials Measurements & Applications, 7th International conference (conf. pub. No. 430), Sep. 23-26, 1996, pp. 21-24.*

(Continued)

*Primary Examiner*—Benny Lee
*Assistant Examiner*—Gerald Stevens

(57) ABSTRACT

A re-entrant microwave resonant cavity comprises a stub 6. A cylindrical wall 2, first end wall 3 and the stub 6 are integrally formed. A second end wall 4 is defined by a metallization layer 8 deposited on a printed circuit board substrate 9. The parts are joined using surface mount soldering processes. The end 11 of the stub 6 defines a gap 12. A rostrum 14 faces the end of the stub 6. The rostrum 14 is manufactured separately and then fixed to the substrate 9. A dielectric sphere 16 is located between the end 11 of the probe stub 6 and the rostrum 14. The dielectric sphere 16 maintains the gap size during use and aids in correct positioning of the parts during manufacture.

29 Claims, 3 Drawing Sheets

OTHER PUBLICATIONS

Kaczkowski et al, "High-Accuracy Wide-Range Measurement Method for Determination of Complex Permittivity in Reentrant Cavity: Part A-Theoretical Analysis of the Method", Mar. 1980, IEEE, vol. MTT-28, pp. 225-228.*

T. J. Mueller, "SMD-Type 42 GHz Waveguide Filter". Proc. IEEE Intern. Microwave Symp., Philadelphia, 2003, pp. 1089-1092.

Lucent patent application, Hesselbarth 2, U.S. Appl. No. 11/524,111, filed concurrently on Sep. 20, 2006, "Re-Entrant Resonant Cavities And Method Of Manufacturing Such Cavities".

Lucent patent application, Hesselbarth 3, U.S. Appl. No. 11/523,998, filed concurrently on Sep. 20, 2006, "Resonant Cavities And Method Of Manufacturing Such Cavities".

Weiguo Xi, "New Results For Coaxial Re-Entrant Cavity With Partially Dielectric Filled Gap", *IEEE Transactions On Microwave Theory And Techniques*, vol. 40, No. 4, Apr. 1992, pp. 747-753.

PCT/US2007/019712, Feb. 21, 2008, PCT Intn'l Search Report.

* cited by examiner

RE-ENTRANT RESONANT CAVITIES, FILTERS INCLUDING SUCH CAVITIES AND METHOD OF MANUFACTURE

FIELD OF THE INVENTION

The present invention relates to re-entrant resonant cavities filters including such cavities and to a method of manufacture of such cavities. More particularly, but not exclusively, it relates to re-entrant resonant cavities suitable for manufacture using surface mount soldering.

BACKGROUND OF THE INVENTION

A resonant cavity is a device having an enclosed volume bounded by electrically conductive surfaces and in which oscillating electromagnetic fields are sustainable. Resonant cavities may be used as filters, for example, and have excellent power handling capability and low energy losses. Several resonant cavities may be coupled together to achieve sophisticated frequency selective behavior.

Since the geometrical shape of a resonant cavity determines its frequency of resonance, high mechanical accuracy is required and, in addition, or alternatively, post-production tuning is applied. For example, tuning mechanisms may be provided, such as tuning screws that project into the cavity volume by a variable amount and are adjusted manually. During operation, thermal expansion of the component parts of a resonant cavity may occur because of changes in ambient temperature and/or self-heating, leading to frequency deviation. This is usually an unwanted effect and various means exist to compensate for temperature variations.

Resonant cavities are often milled in, or cast from, metal. The frequency of operation determines the size of the cavity required, and, in the microwave range, the size and weight are significant.

One known method for reducing the weight of a cavity is to manufacture it in plastic and cover its surface with a thin metal film. If milling is used to shape the plastic, it can be difficult to achieve sufficient accuracy, and surface roughness may be an issue. Molding is another approach, but the tooling is expensive. Also, plastic material has a potentially higher thermal expansion coefficient than metal, which can result in greater frequency deviation attributable to expansion effects. A resonant cavity manufactured from plastic may also lack robustness compared to a metal one.

The strength of the plastic material might be insufficient for conventional means, such as screw connections, to be used to secure the resonant cavity in position and for connecting input and output transmission means for coupling energy into and out of the cavity. An alternative to the conventional fixing means used with metal cavities is surface mount soldering. However, the unpredictability of solder flow during the process can be detrimental to achieving accurate placement of resonant cavities.

T. J. Mueller, "SMD-type 42 GHz waveguide filter", Proc. IEEE Intern. Microwave Symp., Philadelphia, 2003, pp. 1089-1092 describes manufacture of a waveguide filter using surface mount soldering in which a U-shaped metal filter part is soldered onto a printed circuit board (PCB), using the board metallization to define one of the waveguide walls.

BRIEF SUMMARY OF THE INVENTION

According to an aspect of the invention, a re-entrant resonant cavity comprises: an electrically conductive surface defining a volume and including a re-entrant stub having an end face, there being a capacitive gap between the end face and a facing portion of the surface; and a dielectric member located in the gap.

In a re-entrant resonant cavity, the electric and magnetic parts of the electromagnetic field within the cavity volume are essentially geometrically separated. The size of the capacitive gap is critical in defining the resonant frequency. Accordingly, it might be thought that metallized plastic would not be a suitable choice of material for a re-entrant resonant cavity. Metallized plastics cavities usually have large thermal expansion coefficients, which would particularly affect the size of the capacitive gap. In addition, the geometry of the capacitive gap can be affected by strong acceleration or vibration of the device, which would be particularly problematic for re-entrant cavities made from metallized plastics, although metal cavities may also be affected to a certain extent.

In a cavity in accordance with the invention, the dielectric member enables the capacitive gap to be more closely maintained at the required size even during thermal variations. The dielectric member can be produced with small, well-specified thermal expansion coefficients, and with good mechanical tolerances from materials with low dielectric loss, so that it does not have a significant effect on the electromagnetic fields within the cavity volume or its bounding metal surfaces. Suitable materials for the dielectric member include, for example, ceramics such as alumina, glasses and quartz.

By appropriate choice of the thermal expansion coefficient, and the coefficient of temperature-induced variation of the permittivity, of the material of the dielectric member, the resonant cavity may be temperature compensated. In addition, the dielectric member provides mechanical support, reducing the effects of vibration and acceleration on the gap, thus allowing the resonant cavity to be transported and used in more challenging conditions.

Resonant cavities in accordance with the invention may be of metal or of metallized plastic, for example.

The wall opposite that from which the stub is extensive may be substantially planar, such that the portion of the cavity facing the end face of the stub, and defining the capacitive gap with it, is not distinct from the remainder of the surface of that wall. In another embodiment, the facing portion of the surface is a rostrum that is located opposite the end face of the stub. The rostrum is a region that is proud of remainder of the surface of the cavity wall surrounding it, and may be integral or non-integral with the wall. The thickness of the rostrum is selected to provide the required gap dimension in conjunction with the stub and interposed dielectric member.

In one embodiment of the invention, the dielectric member is a sphere. This shape is relatively easy to accurately manufacture. However, other alternative geometries may be used. The dielectric member could be a disk, rugby ball shape or a rod, for example. An indentation may be included in the end face of the stub, the dielectric member being located and held by the indentation. Additionally, or alternatively, an indentation may be included in the facing portion of the surface in which the dielectric member is located. The indentation, or indentations, give additional mechanical stability.

The wall from which the stub is extensive may be made of thinner material than other walls of the cavity. This gives it a spring force to provide a bias which urges the stub in a direction towards the opposite wall to hold the dielectric member. Due to thermal expansion effects, the spring force is a minimum at the highest temperature and maximum at the lowest temperature.

In one embodiment of the invention, the resonant cavity comprises an integral metallized molded plastic component that includes: a cylindrical wall; the stub; and a first end wall;

the stub being surrounded by the cylindrical wall and extensive from the first end wall in a direction along the longitudinal axis of the cylindrical wall.

According to another aspect of the invention, a microwave filter arrangement includes a plurality of re-entrant resonant cavities in accordance with the invention. Where a plurality of the cavities is fabricated on a common printed circuit board substrate, with metallization on the substrate forming walls of the cavities, coupling between cavities may be achieved via conductive tracks carried by the substrate. A filter arrangement in accordance with the invention offers particular advantages for applications in which weight and size must be minimized while still providing a robust structure, for example, for use in telecommunications apparatus where is desired to mount one or more filter arrangements in close proximity to antenna elements.

According to another aspect of the invention, a method for manufacturing a re-entrant resonant cavity arrangement includes the steps of: providing a first cavity part which comprises a re-entrant stub having an end face; providing a second cavity part; joining the first and second parts; and providing a dielectric member between the end face of the stub and a facing portion of the second cavity part.

The invention enables a re-entrant resonant cavity to be manufactured, for example, using soldering to locate and fix one part of the cavity to another part with solder between them. It might be thought that soldering would not be suitable for this type of construction. It is difficult to control the thickness of solder because solder flow during fabrication is unpredictable and, thus, achieving the correct gap size is impracticable. However, by using a method in accordance with the invention, the dielectric member ensures that the correct spacing is achieved between the end face of the stub and the facing metal surface, despite the potential variation in gap geometry because of solder between the two parts.

In one method in accordance with the invention, an indentation is included in the end face of the stub. The dielectric member is located and held by the indentation. Additionally, or alternatively, an indentation may be included in the facing portion of the surface in which the dielectric member is located. Such indentations may be formed with great accuracy during molding, for example, and permit accurate lateral relative placement of the cavity parts to be achieved during manufacture.

Also, the invention permits surface mount technology to be used in manufacturing a re-entrant resonant cavity. The second cavity part may be a metallized printed circuit board substrate, although other planar metal or metallized surfaces may be used as alternatives. The dielectric member locates the cavity parts during soldering so that they are correctly aligned with one another, and also laterally positioned on the substrate.

The method in accordance with the invention is particularly advantageous where the cavity is of metallized plastic. It offers repeatability, relatively cheap manufacture for high volumes, the cavities are lightweight and there is good frequency control achievable. However, it may also be used where the cavity is of metal, which may, for example, be soldered or brazed onto a printed circuit board or other suitable substrate.

The method may be used for re-entrant resonant cavities without a rostrum and for those that do include a rostrum.

In one method in accordance with the invention, a plurality of different sized rostrums is available, from which one is selected to be included in the cavity. The costs for the tools for molding plastic parts are significant. The tooling for the more complex part that includes the stub is more expensive than that required for the rostrum. Re-entrant cavities may be provided which have different resonant frequencies by using the same more complex part in each case, but choosing a different rostrum according to the desired frequency performance of the cavity. Different size dielectric members are also made available in this method.

Another method in accordance with the invention includes the steps of manufacturing a plurality of cavities and connecting them together to form a filter circuit.

BRIEF DESCRIPTION OF THE DRAWINGS

Some methods and embodiments of the present invention will now be described by way of example only, and with reference to the accompanying drawings, not drawn to scale, in which.

DETAILED DESCRIPTION OF THE DRAWINGS

Figure 1:
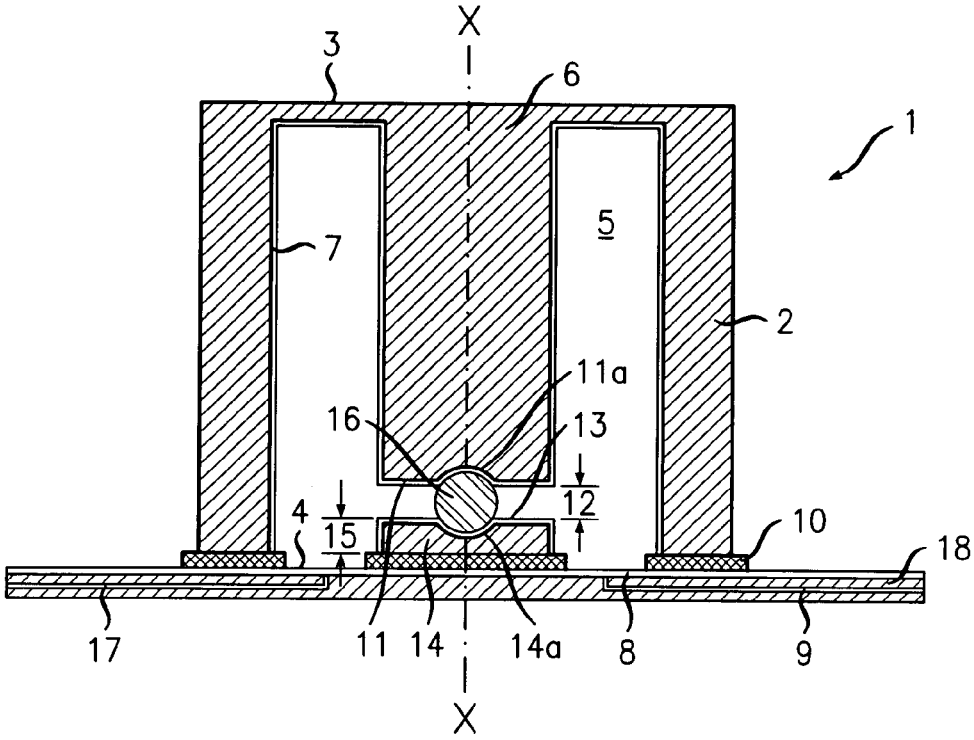
FIG. 1 schematically illustrates a resonant cavity in accordance with the invention.

With reference to FIG. 1, a re-entrant microwave resonant cavity 1 comprises a cylindrical wall 2, with first and second end walls 3 and 4 respectively at each end to define a generally cylindrical volume 5 between them. A stub 6 is extensive from the first end wall 3 into the volume 5, being located along the longitudinal axis X-X of the cylindrical wall 2. The cylindrical wall 2, first end wall 3 and stub 6 are integrally formed as a single molded plastic component, the interior surface of which is metallized with a layer 7 of silver. The first end wall 3 is relatively thin compared to the thickness of the cylindrical wall 2. The second end wall 4 is defined by a metallization layer 8 carried by a printed circuit board substrate 9. The cylindrical wall 2 is joined to the metallization layer 8 by solder 10 laid down in a surface mount soldering process during fabrication of the device.

The end face 11 of the stub 6 defines a gap 12 between it and the facing portion 13 of the second end wall 4. The facing portion 13 of the second end wall 4 is formed by a rostrum 14, which is of substantially the same diameter as that of the stub 6 in this embodiment and has a height 15. The rostrum 14 is a metallized molded plastic piece that is non-integral with the other parts of the cavity 1 and is soldered in place on the substrate 9. A dielectric sphere 16 is located between the end 11 of the stub 6 and the rostrum 14. There is an indentation 11*a* in the end face 11 of the stub 6 and an indentation 14*a* in the rostrum 14 to hold and locate the dielectric sphere 16.

The cavity 1 has an input for signal energy via a copper track 17 in the substrate 9 and an output via another copper track 18. These are used to couple energy into and out of the cavity volume 5, and allow the cavity 1 to be readily coupled to other similar cavities to form a filter, for example.

During operation, thermal expansion causes the stub 6 to be forced towards the dielectric sphere 16 by the more flexible thin first end wall 3. The dielectric sphere 16 enables an accurate gap distance 12 to be maintained during operation of the resonant cavity 1 and stabilizes the stub 6 so as to reduce vibrational effects on performance.

Figure 2:
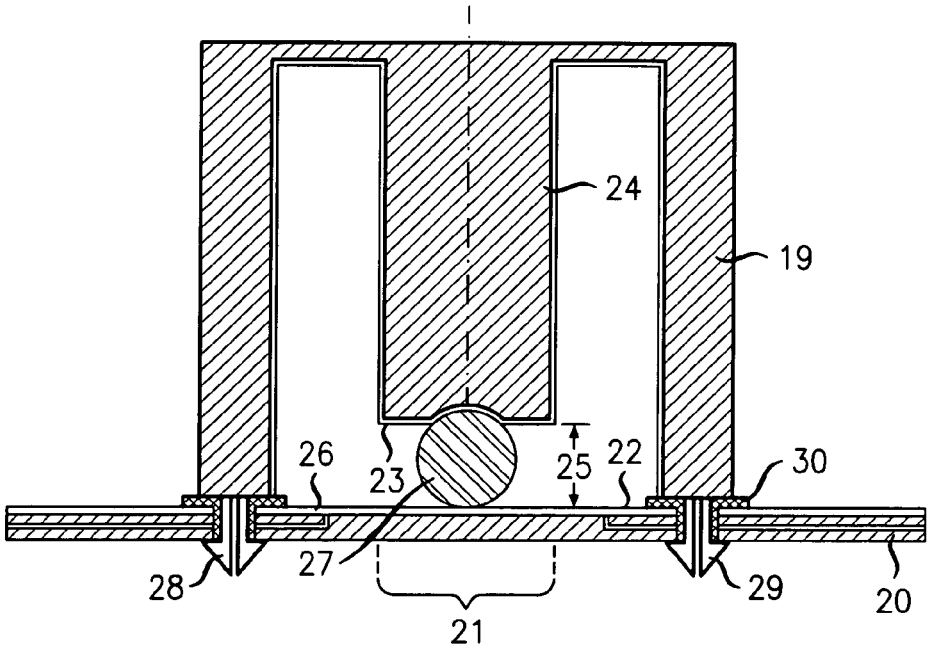
FIG. 2 schematically illustrates another resonant cavity in accordance with the invention.
Figure 3A:
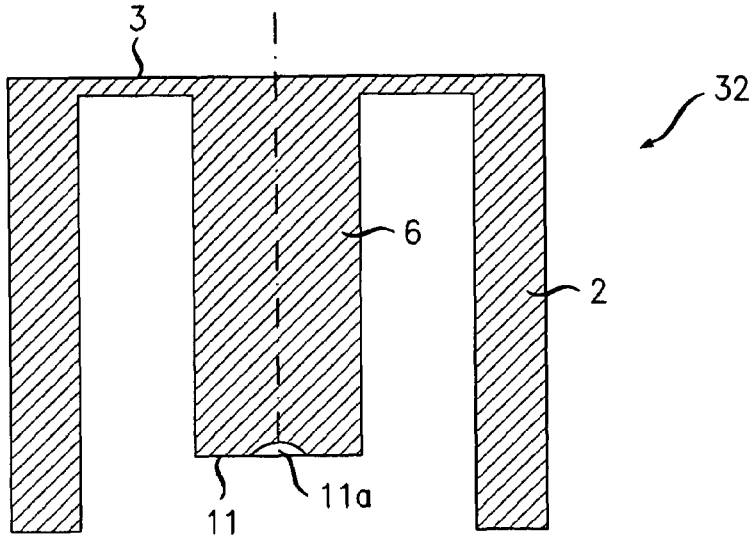
FIGS. 3(*a*) to 3(*d*) schematically illustrate steps in a method of manufacturing the resonant cavity of FIG. 1.
Figure 3B:
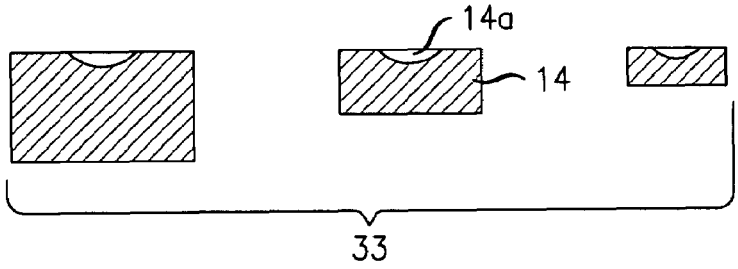
Figure 3C:
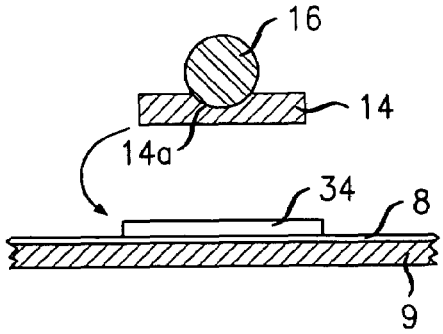
Figure 3D:
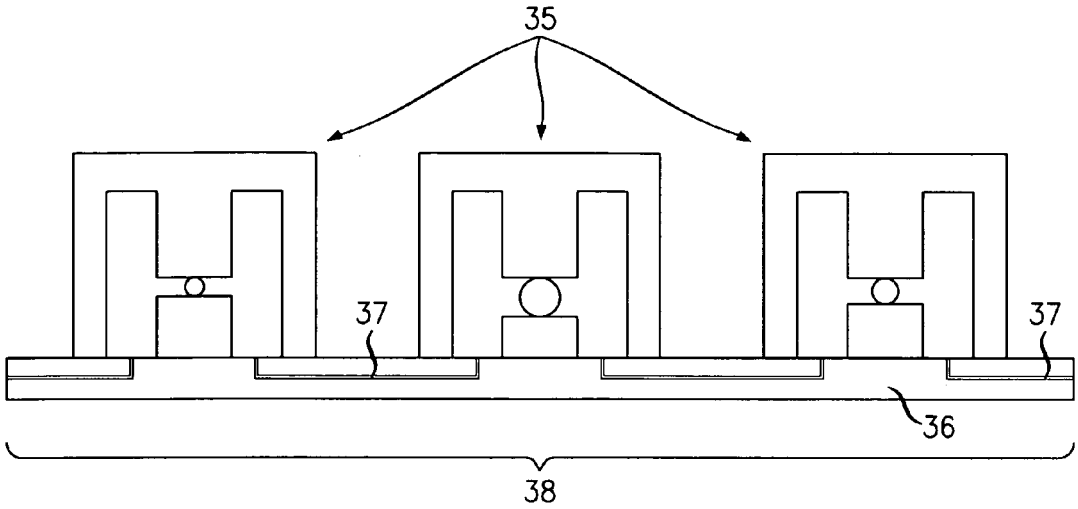

With reference to FIG. 2, another re-entrant resonant cavity is similar to that shown in FIG. 1, comprising a metallized plastic molded part 19 soldered to a printed circuit board substrate 20. However, no rostrum is included in this design. The portion 21 of a second cavity end wall 22 facing the end 23 of a stub 24 defines a gap 25 between the substrate 20 and the end 23 of the stub 24. The facing portion 21 is continuous with, and part of, a metallization layer 26 on the substrate 20. A dielectric sphere 27 is located between the metallization layer 26 at the facing portion 21 and the end 23 of the stub 24. Also, in this embodiment, snaps 28 and 29 assist in locating molded part 19 with respect to the substrate 20 during fabrication. Solder 30 joins the molded part 19 to the substrate 20. No solder is included between the dielectric sphere 27 and the metallization layer 26.

Although the resonant cavities shown in FIGS. 1 and 2 comprise components of molded plastic, they could be fabricated by another technique, for example, by milling, or alternatively, be made wholly from metal.

A method for manufacturing the resonant cavity of FIG. 1 is now described with reference to FIG. 3.

Injection molding is used to produce a plastic component 32, shown in FIG. 3(*a*), that in the finished resonant cavity includes the cylindrical wall 2, first end wall 3 and stub 6 having an indentation 11*a* in the end face 11. Metallization is applied to the surfaces that will be in the interior of the cavity in the finished device. The metallization is applied by spraying, although other methods are also possible to achieve a sufficiently complete coating for electrical purposes.

The gap between the end face 11 of the stub 6 and the facing portion of the second end wall is critical in defining a capacitance and hence the resonant frequency of the cavity. A suitable rostrum is selected from a set 33 of different dimensions, varying in diameter and/or height as shown in FIG. 3(*b*). The dimensions of the rostrum define the capacitive gap in the finished device. In this case, the second rostrum 14 of the three possible choices is selected.

With reference to FIG. 3(*c*), a dielectric sphere 16 is glued to the selected rostrum 14, in the indentation 14*a*, and then the rostrum 14 placed on a solder pad 34 on the printed circuit board substrate 9. The temperature is increased to cause the solder to flow and fix the rostrum 14 in position. Then the plastic component 32 is placed in position on solder pads corresponding to the cylindrical wall 2, with the indentation 11*a* in the end face 11 of the stub 6 accepting the dielectric sphere 16. The indentations 14*a* and 11*a* hold and locate the dielectric sphere 16, enabling accurate lateral relative placement of the component 32 and rostrum 14. The assembly is soldered to obtain the finished cavity as shown in FIG. 1 in which the component 32 is joined to the substrate 9 by solder 10.

The method may be used to manufacture a single cavity at a time. In an extension of it, however, a plurality of cavities is fabricated simultaneously using the method. FIG. 3(*d*) shows an arrangement of several resonant cavities 35 which are manufactured on a common substrate 36 having connecting tracks 37 therethrough, to provide a filter arrangement 38. The connecting tracks provide coupling for signals between cavities included in the filter arrangement 38 to obtain the required frequency selective behavior.

Figure 4:
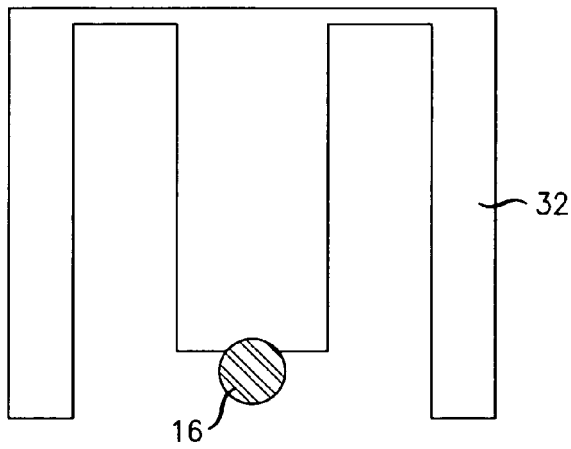
FIG. 4 schematically illustrates a step in another method in accordance with the invention.

FIG. 4(*a*) shows an alternative method step to the step shown in FIG. 3(*c*). The dielectric sphere 16 is glued to the plastic component 32 prior to it being offered up to the substrate for surface mount soldering. This step is suitable for both devices that include a rostrum and for those that do not.

The present invention may be embodied in other specific forms, and carried out by other methods, without departing from its spirit or essential characteristics. The described embodiments and methods are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A filter arrangement including a plurality of re-entrant resonant cavities, at least one of which comprises: an electrically conductive surface defining a volume and including a re-entrant stub having an end face, the stub and a first end wall of the cavity being included in an integral metallized plastic component, a capacitive gap between the end face and a facing portion of the surface; and a dielectric member located in the gap in contact with the end face and the facing portion; and wherein said first end wall is resiliently deformable and biases the stub in a direction towards the facing portion; and said plurality of re-entrant resonant cavities being connected to filter applied signals.

2. The filter arrangement as claimed in claim 1 and wherein said plurality of re-entrant resonant cavities is carried on a common substrate.

3. The filter arrangement as claimed in claim 2 and wherein the common substrate is a metallized printed circuit board, and metallization on the substrate defines electrically conductive surfaces of the cavities.

4. The filter arrangement as claimed in claim 3 and including conductive tracks carried by the substrate for coupling signals between the cavities.

5. The filter arrangement as claimed in claim 1 and wherein the first end wall from which the stub is extended is thinner than other walls of the cavity such that said first end wall biases the stub in a direction towards the facing portion.

6. A re-entrant resonant cavity comprising: an electrically conductive surface defining a volume and including a re-entrant stub having an end face, the stub and a first end wall of the cavity being included in an integral metallized plastic component, a capacitive gap between the end face and a facing portion of the surface; and a dielectric member located in the gap in contact with the end face and the facing portion; and wherein said first end wall is resiliently deformable and biases the stub in a direction towards the facing portion.

7. The cavity as claimed in claim 6 and wherein the electrically conductive surface defining a volume is, at least in part, molded metallized plastic.

8. The cavity as claimed in claim 7 and wherein the integral metallized plastic component includes: a cylindrical wall; the stub; and the first end wall; the stub being surrounded by the cylindrical wall and extended from the first end wall in a direction along the longitudinal axis of the cylindrical wall.

9. The cavity as claimed in claim 8 and wherein said electrically conductive surface includes a second end wall opposite to the first end wall and defined by a metallization layer on a printed circuit board.

10. The cavity as claimed in claim 6 and wherein said electrically conductive surface defining a volume is, at least in part, provided by the surface of a metal component.

11. The cavity as claimed in claim 10 and comprising: a cylindrical wall; the stub; and the first end wall; the stub being surrounded by the cylindrical wall and extended from the first end wall in a direction along the longitudinal axis of the cylindrical wall; and further comprising a second end wall opposite to the first end wall and defined by a metallization layer on a printed circuit board.

12. The cavity as claimed in claim 6 and wherein the dielectric member is spherical.

13. The cavity as claimed in claim 6 and wherein the first end wall from which the stub is extended is thinner than other walls of the cavity such that said first end wall biases the stub in a direction towards the facing portion.

14. The cavity as claimed in claim 6 and wherein the facing portion of the surface is co-planar with the electrically conductive surface of a wall that is opposite the first end wall from which the stub is extended.

15. The cavity as claimed in claim 6 and wherein the facing portion of the surface is the surface of a rostrum, said facing portion being in a different plane to the electrically conductive surface that surrounds said facing portion.

16. The cavity as claimed in claim 15 and wherein the rostrum is non-integral with the electrically conductive surface that surrounds said rostrum.

17. The cavity as claimed in claim 6 and wherein the electrically conductive surface of a wall that is opposite the first end wall from which the stub is extended is defined by a metallization layer on a printed circuit board.

18. The cavity as claimed in claim 17 and comprising at least one conductive track carried by the printed circuit board for transmission of a signal into and/or out of the volume.

19. The cavity as claimed in claim 6 and including an indentation in the end face of the stub in which the dielectric member is located.

20. The cavity as claimed in claim 6 and including an indentation in the facing portion of the surface in which the dielectric member is located.

21. A method for manufacturing a re-entrant resonant cavity arrangement including the steps of: providing a first cavity part comprising an integral metallized plastic component which includes a re-entrant stub having an end face and a first end wall of the cavity; providing a second cavity part; joining the first and second cavity parts; and providing a dielectric member between the end face of the stub and a facing portion of the second cavity part and in contact with the end face and the facing portion and wherein said first end wall is resiliently deformable and biases the stub in a direction towards the facing portion.

22. The method as claimed in claim 21 and including the step of joining the first and second cavity parts by soldering.

23. The method as claimed in claim 22 and wherein the second cavity part is a metallized printed circuit board and surface mount soldering is used to join the first and second cavity parts.

24. The method as claimed in claim 21 and including the steps of providing a third cavity part and locating the third cavity part between the first and second cavity parts and opposite the end face of the stub.

25. The method as claimed in claim 24 and including the steps of: providing a plurality of third cavity parts; and selecting one only of the plurality of third cavity parts for location between the first and second cavity parts.

26. The method as claimed in claim 21 and including the steps of manufacturing a plurality of cavities and connecting them together to form a filter circuit.

27. The method as claimed in claim 21 and including an indentation in the end face of the stub in which the dielectric member is located.

28. The method as claimed in claim 21 and including an indentation in the facing portion of the surface in which the dielectric member is located.

29. The method as claimed in claim 21 and wherein the first end wall from which the stub is extended is thinner than other walls of the cavity such that said first end wall biases the stub in a direction towards the facing portion.

* * * * *